United States Patent [19]

Greenlee et al.

[11] Patent Number: 4,530,398

[45] Date of Patent: Jul. 23, 1985

[54] RETRIEVABLE WELL BORE PACKER

[75] Inventors: Donald R. Greenlee; Albert E. Kline, both of Tulsa, Okla.

[73] Assignee: Arrow Oil Tools, Inc., Tulsa, Okla.

[21] Appl. No.: 404,386

[22] Filed: Aug. 2, 1982

[51] Int. Cl.[3] ..... F21B 23/06

[52] U.S. Cl. ..... 166/123; 166/217; 166/134

[58] Field of Search ..... 166/123, 133, 134, 217

[56] References Cited

U.S. PATENT DOCUMENTS

| | | | |
|---|---|---|---|
| 2,714,931 | 8/1955 | Bouvier | 166/123 |
| 3,045,758 | 7/1962 | Muse | 166/217 |
| 3,344,861 | 10/1967 | Claycomb | 166/123 |
| 3,429,375 | 2/1969 | Craig | 166/134 |
| 3,602,305 | 8/1971 | Kisling | 166/123 |
| 3,631,925 | 1/1972 | Nutter | 166/123 |
| 3,631,926 | 1/1972 | Young | 166/123 |
| 3,667,543 | 6/1972 | Dean | 166/125 |
| 3,678,998 | 7/1972 | Cockvell | 106/123 |
| 3,783,941 | 1/1974 | Kisling | 166/217 |
| 4,156,460 | 5/1979 | Crowe | 166/123 |

*Primary Examiner*—James A. Leppink
*Assistant Examiner*—Thuy M. Bui
*Attorney, Agent, or Firm*—Steven L. Permut; Leon E. Redman; Malcolm L. Sutherland

[57] ABSTRACT

A retrievable seal bore packer adapted to be lowered into a casing on a wireline and set by a wireline gun. The packer is retrieved by a retrieving tool lowered into the casing on a wireline by a downward force followed by an upward force on the wireline. The packer has a cylindrical mandrel, selectively engageable slips, a lower cylindrical element encircling the mandrel and bearing against the bottom of the slip and an upper cylindrical element encircling the mandrel and bearing against the top of the slip. The wireline gun is interconnected with the cylindrical mandrel and the upper cylindrical element to selectively cause relative movement therebetween and to thereby engage the slips with the casing.

7 Claims, 23 Drawing Figures

RETRIEVABLE WELL BORE PACKER

BACKGROUND

The present invention relates to well devices and more particularly to packers used in oil wells and to similar devices.

Well packers and similar well devices are used in oil and gas production to separate a well bore into two regions—the region above and the region below the packer. Since it is often only necessary to temporarily set a packer in a casing, many designs have been suggested for temporary or retrievable packers. Examples of retrievable packers are described in U.S. Pat. Nos. 3,398,795 (issued Aug. 27, 1978), 3,667,543 (issued June 6, 1972), 3,818,987 (issued June 25, 1974) and 4,151,867 (issued May 1, 1979). The principal disadvantage with previous designs for retrievable well packers is that they are expensive to manufacture or to use due to the large number of components. Many require special devices for actuation. Only a few provide for the passage of a wireline through the packer when operations must be performed in the region below the packer.

The primary object of the present invention is to provide a well packer which may be set in a casing by interconnecting the packer with a wireline gun, lowering the packer into the casing, and actuating the wireline gun.

Another object of the present invention is to provide a well packer which may be retrieved from a well by lowering a retrieving tool into the well until it encounters the packer, continuing to advance the retrieving tool a short distance, and then pulling upwardly on the retrieving tool without the need for rotational motion of the retrieving tool.

Still another object of the present invention is to provide a well packer which may be permanently or temporarily set in a well and in which the packer permits a large number of operation to be accomplished without requiring removal of the packer from the casing. The present invention accomplishes this by providing a large bore through the entire length of the packer.

The many objects, features and advantages of the present invention will become apparent to those skilled in the art when the detailed description of the preferred embodiments is read together with the drawings which are attached hereto.

SUMMARY

The present invention provides a packer which may be run in on a wireline and set by use of a wireline gun. The present invention further provides a packer which may be retrieved by a retrieving tool run in on a wireline. Finally, the present invention provides a packer which can be left in the well bore while various operations are performed within the bore either above or below the packer.

The packer of the present invention has a cylindrical or inner mandrel and several selectively engageable slips. The packer further has a lower cylindrical element encircling the inner mandrel and bearing against the bottom of the slip and an upper cylindrical element encircling the inner mandrel and bearing against the top of the slip. The wireline gun is interconnected with the cylindrical mandrel and the upper cylindrical element to selectively cause relative movement therebetween and, thereby, to engage the slips with the casing.

In the preferred embodiment, the packer of the present invention has two oppositely oriented slip assemblies provided along its length. Each slip assembly has several slips encircling the cylindrical or inner mandrel. Each slip assembly further has a slip body fitted over the slips but provided with apertures for passage of a portion of the slips therethrough. A spring is provided between each slip and its associated slip body to bias the slip body towards the inner mandrel. A sleeve having a conical portion at one of its end is provided near each of the slip assemblies. When the wireline gun is activated, the relative movement of the upper cylindrical element relative to the inner mandrel forces the conical portion of the sleeves to become wedged between its associated slips and the inner mandrel.

The packer of the present invention is run in on electric wireline, attached to a standard wireline. After settling depth is reached, the wireline gun is actuated, applying shear forces to the packer—upward on the inner mandrel and downward on the packer body. Shear pins that have prevented premature settling during run-in then will break. The upper and lower cones are driven toward the upper and lower slips, forcing them against the casing wall and preventing further movement of the packer body. All settling force is then applied directly to the packing elements, compressing them to a tight seal against the casing, until a pre-set force (normally 30,000 lbs.) is reached, when shear pins at the top of the packer will break, freeing the setting tool and adapter kit from the tool. The setting force is locked in by a spring-loaded split ring which securely locks onto the mandrel.

To release the packer, the retrieving tool is run into the well on tubing or on wireline. When the packer is reached, a latching thread inside the retrieving tool ratchets over a flexible mating thread on the packer, and the release sleeve is driven downwardly forcing the spring-loaded split ring outwardly to disengage the mandrel. The tubing is picked straight up, releasing the upper slips, relaxing the gun and a setting tool and releasing the lower slips. The packer is now free of the casing and can be pulled from the well.

BRIEF DESCRIPTION OF THE DRAWINGS

FIG. 1*b* forming the lower continuation of FIG. 1*a;*

DETAILED DESCRIPTION OF THE PREFERRED EMBODIMENT

Figure 1A:
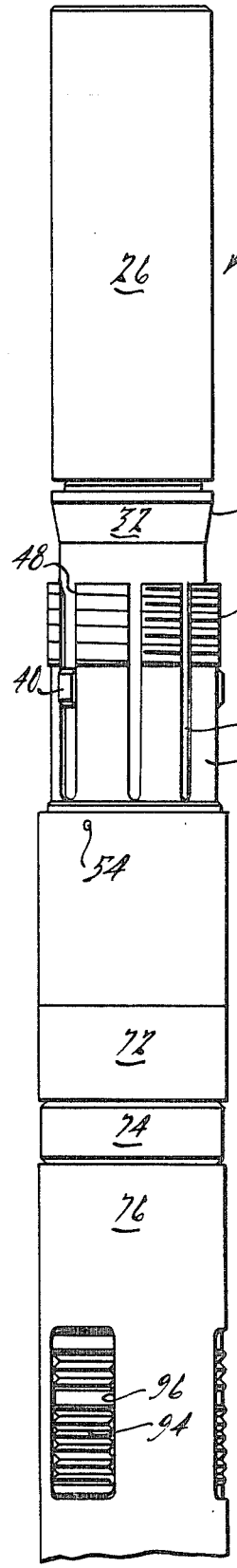
FIGS. 1*a* and 1*b* together form an elevational view of the packer of the present invention.
Figure 1B:
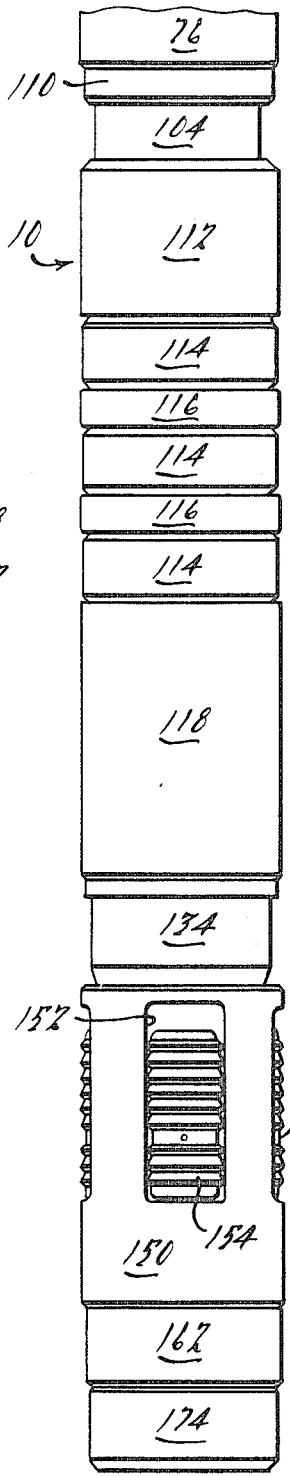

Referring now to the drawing, the packer of the present invention is generally indicated by the reference numeral 10, the setting tool by the reference numeral 12 and the retrieving tool by the reference numeral 14. The setting tool 12 (FIG. 2*a*) is interconnected with a wireline gun (not illustrated but well known in the art). The packer 10 is interconnected with the setting tool 12 and is lowered into a casing 16 as illustrated in FIGS. 2*a* through 2*e* prior to a setting operation. During a setting operation, the packer 10 is interconnected with the walls of the casing 16, and is separated from the setting tool 12 in a manner that will be described later herein. During a retrieval operation, the packer 10 is interconnected with the retrieving tool 14 and is disconnected from the walls of the casing 16 in a manner that will also be described later herein.

Figure 2A:
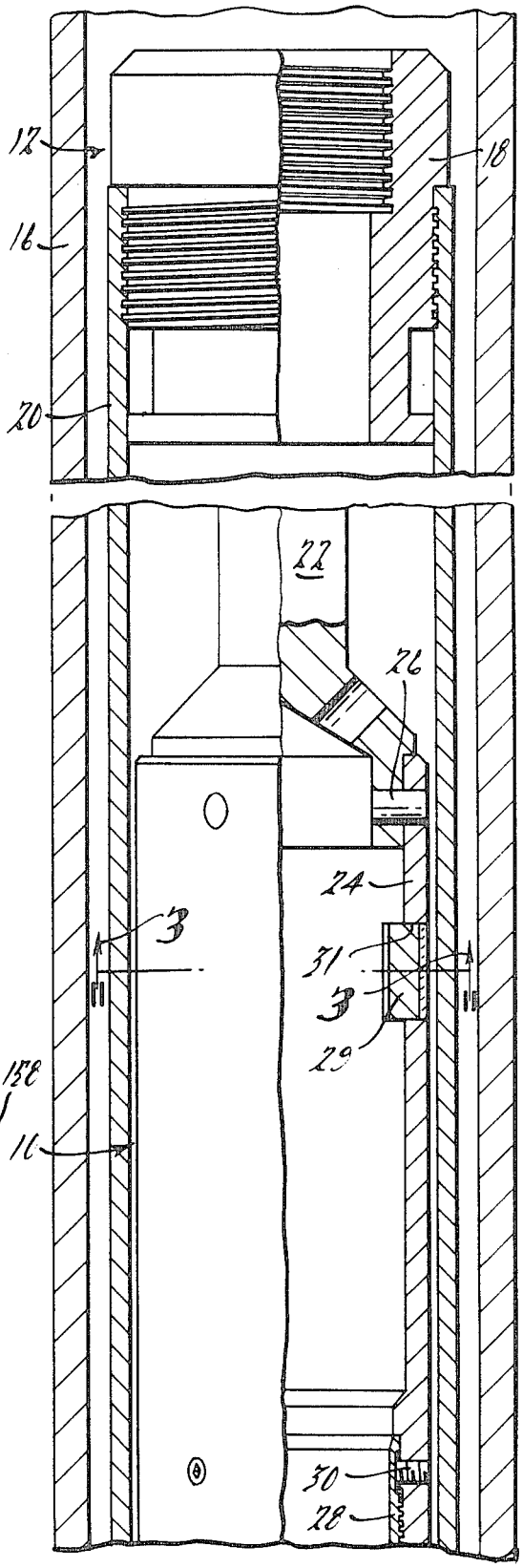
FIGS. 2*a* through 2*e* together form a partly cutaway view of the packer of FIGS. 1*a* and 1*b* interconnected with a setting tool and lowered into a well bore, FIGS. 2*b* through 2*e* generally forming lower continuations of FIGS. 2*a* through 2*d*, respectively.

Referring now to FIG. 2*a*, the setting tool 12 has a generally cylindrical outer setting tool adapter 18 threaded onto the lower end of the outer connection of the wireline gun. A wireline setting sleeve 20 is threaded onto the lower end of the outer setting tool adapter 18. The setting tool 12 further has an inner setting tool adapter 22 located within the outer setting tool adapter 18 and the sleeve 20 such that the wireline gun may be actuated to cause relative movement therebetween.

Figure 3:
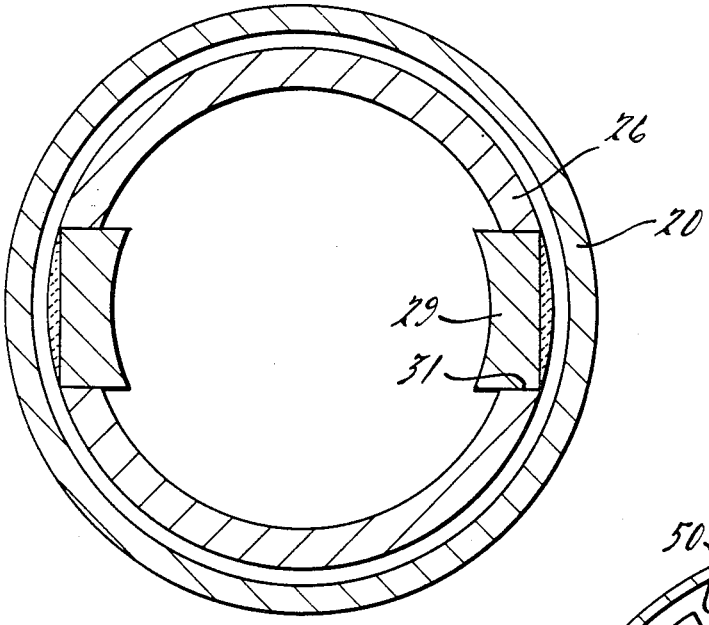
FIGS. 3 through 14 are each sectional views taken through FIGS. 2*a* through 2*e* along line 3—3 through 14—14.

The upper end of the packer 10 is inserted into the sleeve 20 and is interconnected with the inner adapter 22. The uppermost element of the packer 10 is a generally cylindrical top connection element 24 which is interconnected with the inner adapter 22 by means of shear pins 26. As best illustrated in FIG. 3, the top connection 24 may also be provided with several internal lugs 29 for interconnection with other types of connectors than that illustrated. The lugs 29 illustrated have been inserted into apertures 31 in the wall of the top connection element 24 and have been welded to the top connection element 24.

A long cylindrical inner mandrel 28 is threaded into the lower end of the top connection element 24. A screw 30 also secures these elements together. Many details of the inner mandrel 28 will be described later.

Figure 2B:
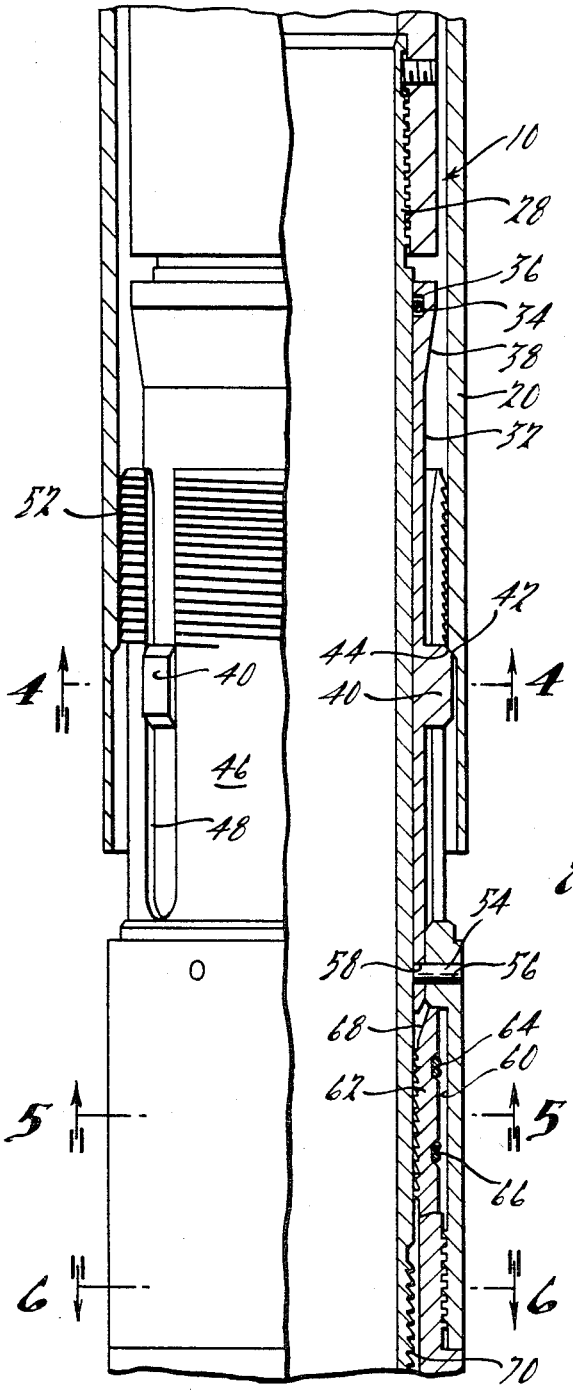
Figure 4:
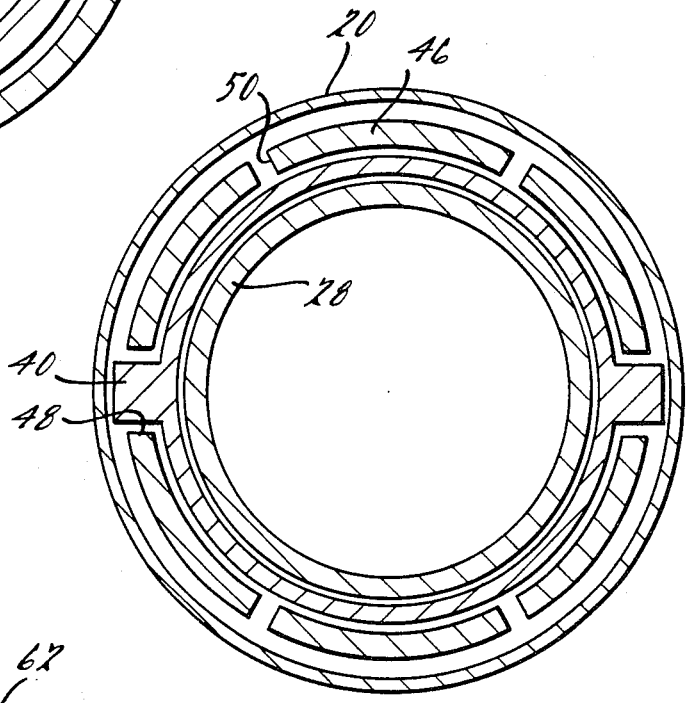

Referring now to FIG. 2*b*, a release sleeve 32 is fitted over the inner mandrel 28 and is spaced a short distance below the top connection element 24. An O-ring 34 is provided in an annular channel 36 in the upper portion of the inner wall of the release sleeve 32. A downwardly oriented outer conical surface 38 is also provided at the upper end of the release sleeve 32. The release sleeve is further provided with several rectangular bosses of lugs 40. In the example illustrated, there are two lugs 40, as best shown in FIG. 4. The lugs 40 are provided with a chamber 42 (FIG. 2*b*) which cooperates with an annular ridge 44 on the inner surface of the outer setting tool adapter 18 such that the outer setting tool adapter 18 will drive the release sleeve 32 downwardly when it is forced downwardly relative to the inner adapter 22.

A release collet 46 is fitted over the lower portion of the release sleeve 32 in the annular region between the release sleeve and the outer adapter 18. As best shown in FIG. 4, the upper portion of the release collet 46 is provided with open slots 48 for the lugs 40 and with additional open slots 50 whereby the upper portion of the release collet is divided into segments which may be separated from each other in a manner described shortly. The outer surface of the segmented upper portion of the release collet 46 is further provided with a left-handed external thread 52 (FIGS. 1*a* and 2*b*). A shear pin 54 is provided to secure the release collet 46 and the release sleeve 32 in position along the inner mandrel 28. The shear pin 54 is passed through an aperture through a portion of the release collet 46 below the segmented upper portion thereof and through an aperture 58 through the lower portion of the release sleeve 32 and abuts the outer surface of the inner mandrel 28.

Figure 5:
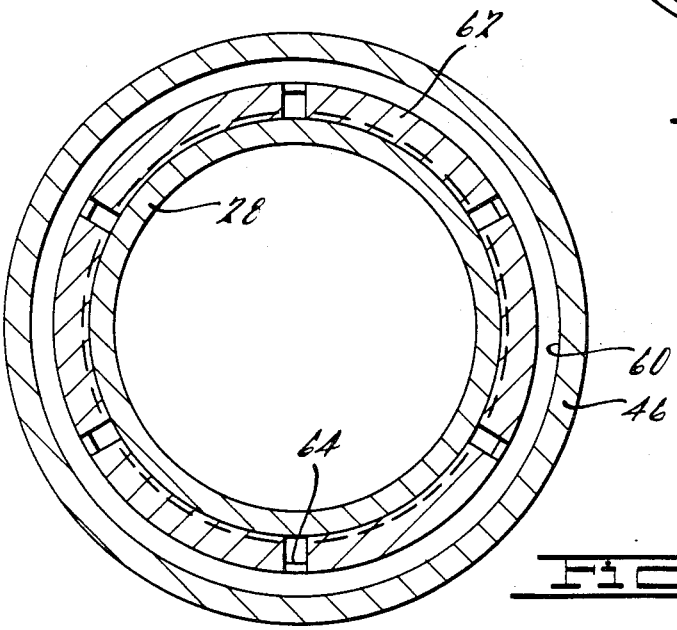
Figure 6:
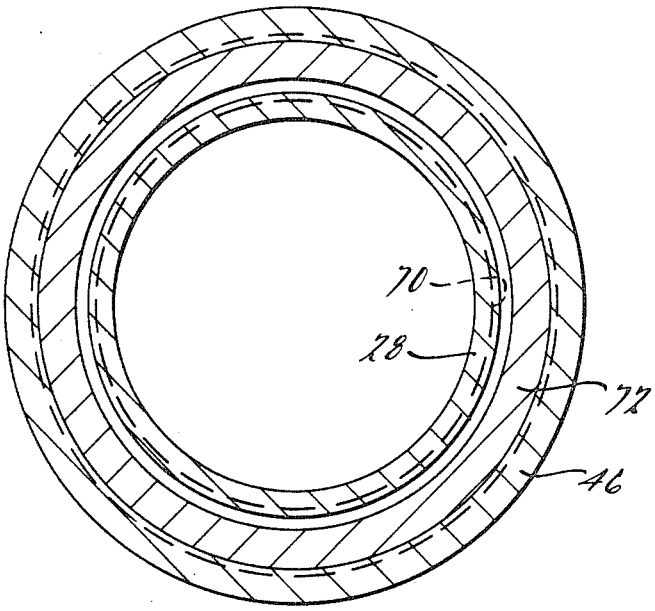
Figure 7:
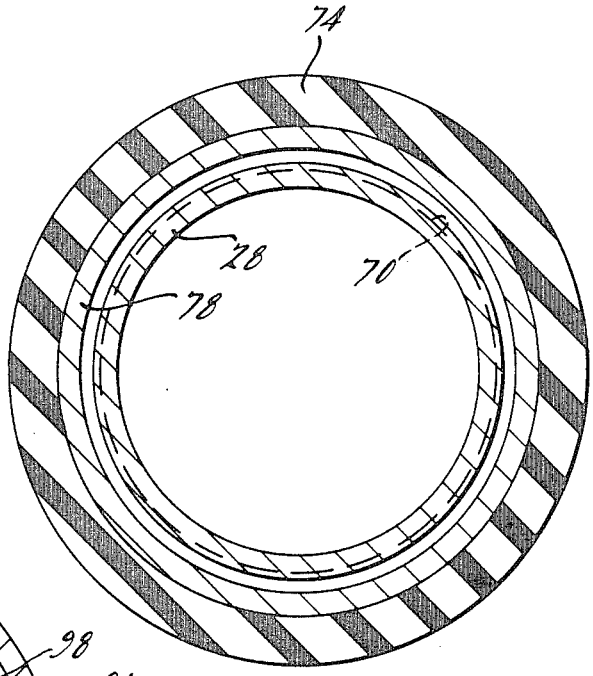

The release collet 46 is also provided at its lower end with an increased diameter inner bore 60. A segmented nut 62 (FIGS. 2*b* and 5) is provided within the annular region between the bore 60 and the outer surface of the inner mandrel 28. The nut 62 is formed from an internally threaded nut which has been cut along several diameters into several nut segments. The individual segments are held together and are biased towards the inner mandrel 28 by two coil springs 64 which are wrapped around the collection of segments and are each located in an appropriate channel 66 on the outer surfaces of the segments. Each of the segments is further provided with an internal chamber 68. The inner mandrel 28 is provided with an externally threaded portion 70 located below the initial position of the nut 62, as shown in FIG. 2*b*. As will be apparent later, the nut 62 engages the threaded portion 70 when the packer 10 is set in the casing 16.

Figure 2C:
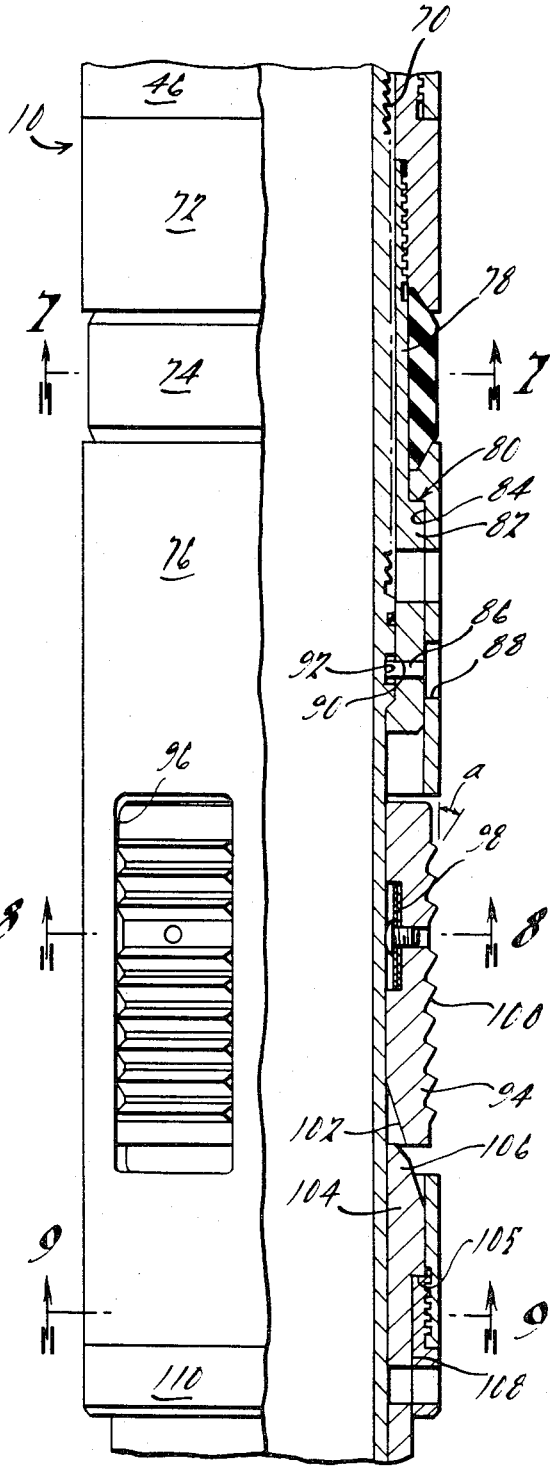

Referring now to FIG. 2*c*, a wireline body 72 is fitted onto the inner mandrel 28 and is threaded into the lower end of the release collet 46. The wireline body 72 prevents the segmented nut 62 from vertical movement relative to the release collet. An upper rubber 74 is loosely fitted onto the inner mandrel 28 and abuts the lower end of the wireline body 72. An upper slip body 76 is loosely fitted onto the inner mandrel 28 and abuts the lower end of the upper rubber 74. An upper rubber mandrel 78 is inserted into the annular gap between the inner mandrel 28 and the elements 74 and 76. The upper end of the upper rubber mandrel 78 is threaded into the lower end of the wireline body 72. As shown at 80 in FIG. 2*c*, the upper rubber mandrel 78 is provided with an enlarged outer diameter lower portion 82 and the upper slip body 76 is provided with an enlarged inner diameter portion 84 whereby the upperslip body 76 may only move upwardly relative to the upper rubber mandrel 78. A shear pin 86 interconnects the upper rubber mandrel 78 with the inner mandrel 28. The shear pin 86 is inserted past a clearance aperture 88 in the upper slip body 76. The shear pin is inserted partly through an aperture 90 in the upper rubber mandrel and into a channel 92 in the outer surface of the inner mandrel 28.

Figure 8:
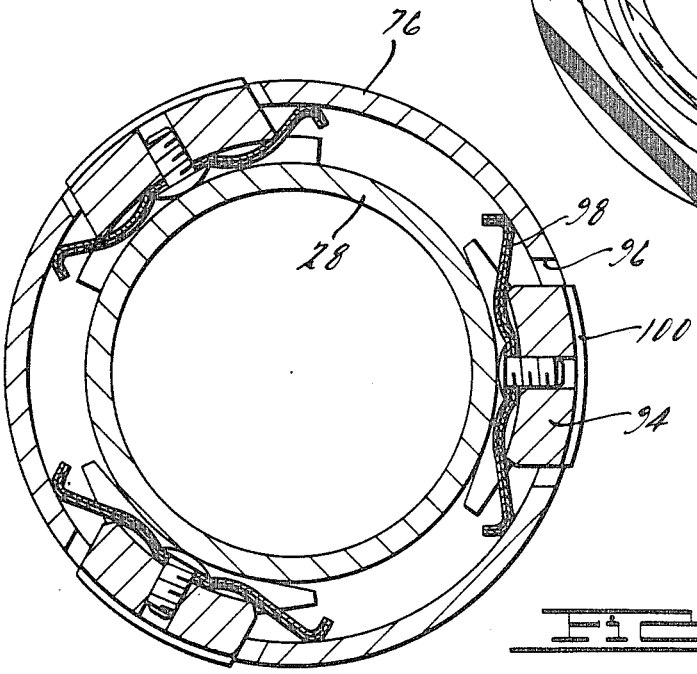
Figure 9:
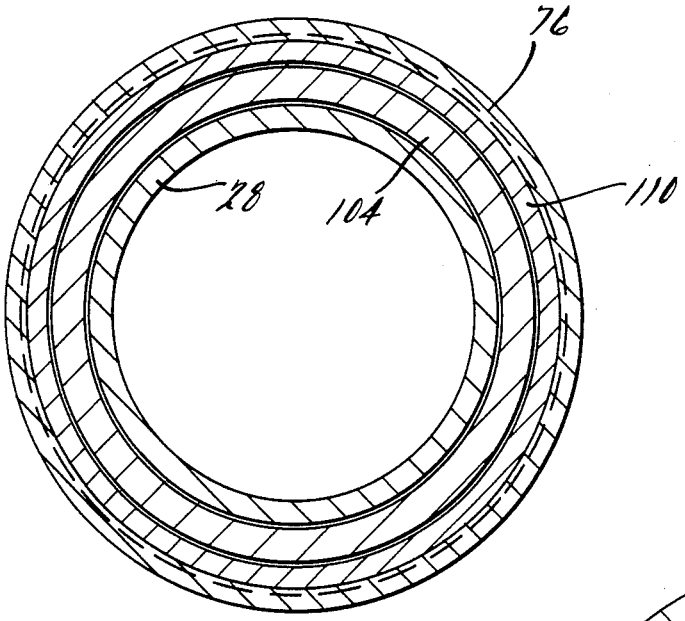
Figure 10:
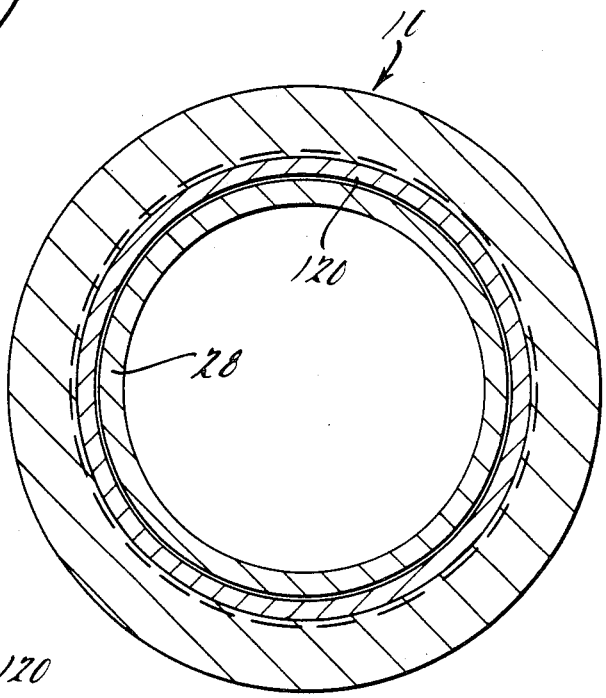
Figure 11:
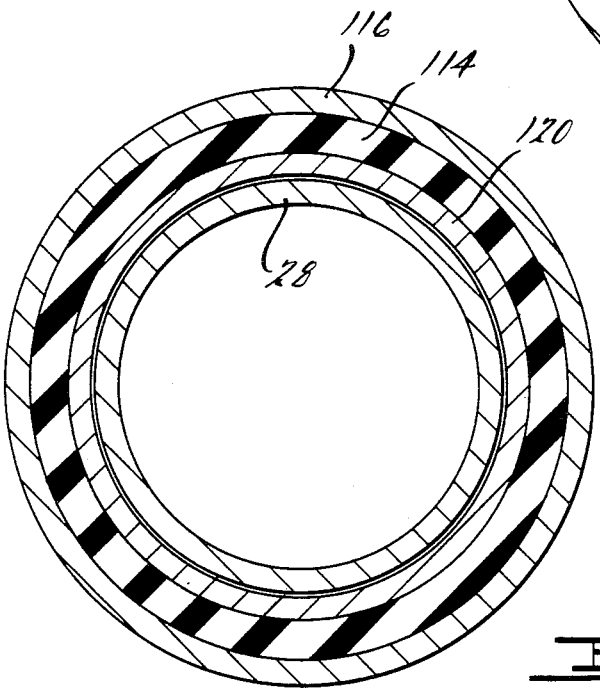
Figure 12:
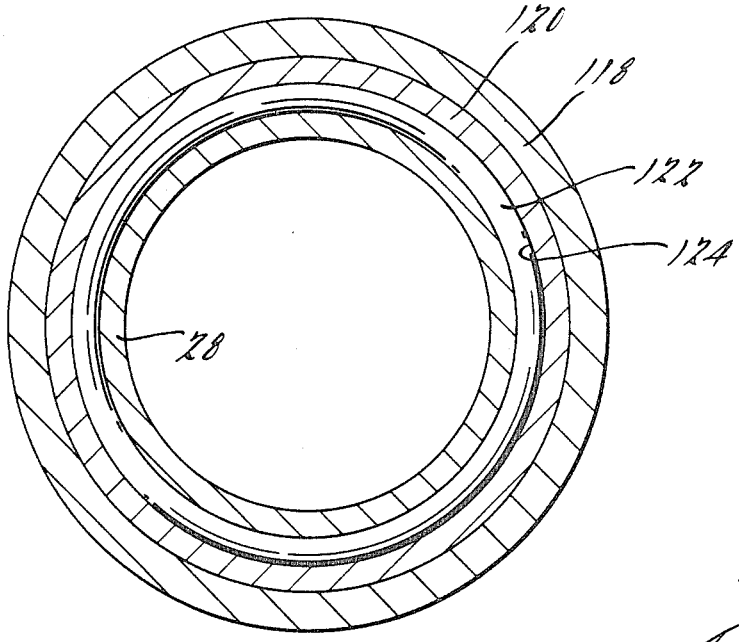

Several upper slips 94 (FIGS. 2*c* and 8) are located within the annular region between the upper slip body 76 and the inner mandrel 28. In the example illustrated, three slips 94 are shown. For each of the slips there is provided an aperture or window 96 in the upper slip body 76 whereby each slip 94 may be selectively extended through a window 96. Each of the slips 94 is provided with an external surface 100 capable of gripping the wall of the well casing 16 when the slips are forced outwardly through the windows 96 in a manner described later herein. Each of the slips 94 is biased by means of a spring 98 towards the inner mandrel 28. Each of the slips 94 is provided with an outwardly and downwardly sloping surface 102 at the lower end of its inner surface.

An upper cone 104 is fitted onto the lower mandrel 28 and is into the lower end of the upper body slip 76 to a position just below the upper slips 94. The uppermost end of the upper cone 104 is provided with a conical portion 106. The conical portion 106 is provided to cooperate with the sloping surface 102 of the slips 94 to force the upper cone under the upper slip during a setting operation and to thereby force the slips against the casing 16. The upper cone 104 is provided with an enlarged outer diameter in the region of the conical portion 106 and is thereby provided with an annular shoulder 105 between the conical portion 106 and the outer cylindrical surface 108 of the remainder of the upper cone. A nut 110 is provided between the outer cylindrical surface 108 of the upper cone 104 and the lower end of the upper slip body 76. The nut 110 is threaded into the lower end of the upper slip body and abuts the shoulder 106 of the upper cone 104. The upper cone 104, as well as all the elements connected to the upper cone supported by the nut 110.

Figure 2D:
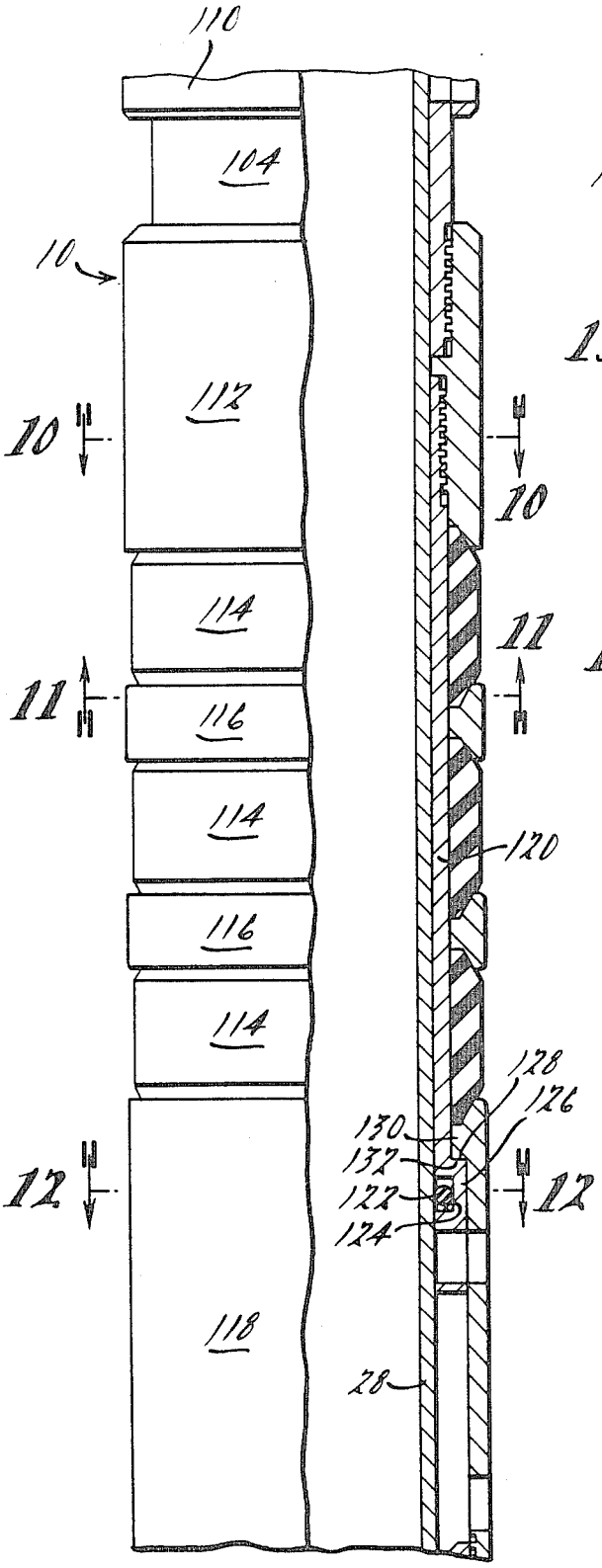

Referring now to FIG. 2*d*, a center coupling 112 is threaded onto the lower end of the upper cone 104. Three lower rubbers 114 and two spacers 116 are loosely fitted onto the inner mandrel 28 below the center coupling 112 such that the spacers 116 are located between pairs of rubbers 114 and so that the uppermost of the lower rubbers abuts the bottoms of the upper coupling 112. A rubber retainer 118 is loosely fitted onto the inner mandrel 28 and abuts the lowermost rubber 114. A lower rubbeer mandrel 120 is fitted into the annular region between the outer surface of the inner mandrel 28 and the inner surfaces of the rubbers 114, the spacers 116 and the retainer 118. The uppermost end of the lower rubber mandrel 120 is threaded into the lower end of the center coupling 112. An O-ring 122 is provided in a channel 124 in the inner surface of the lower mandrel 120.

The lower end of the lower rubber mandrel 120 is provided with an enlarged outer diameter portion 126 defining an upwardly oriented shoulder 128. The upper end of the retainer 118 is provided with a similar decreased inner diameter portion 130 defining a downwardly oriented shoulder 132. The shoulder 128 and 130 cooperate to prevent the retainer from moving downwardly relative to the lower rubber mandrel but to permit upward motion relative thereto.

Figure 2E:
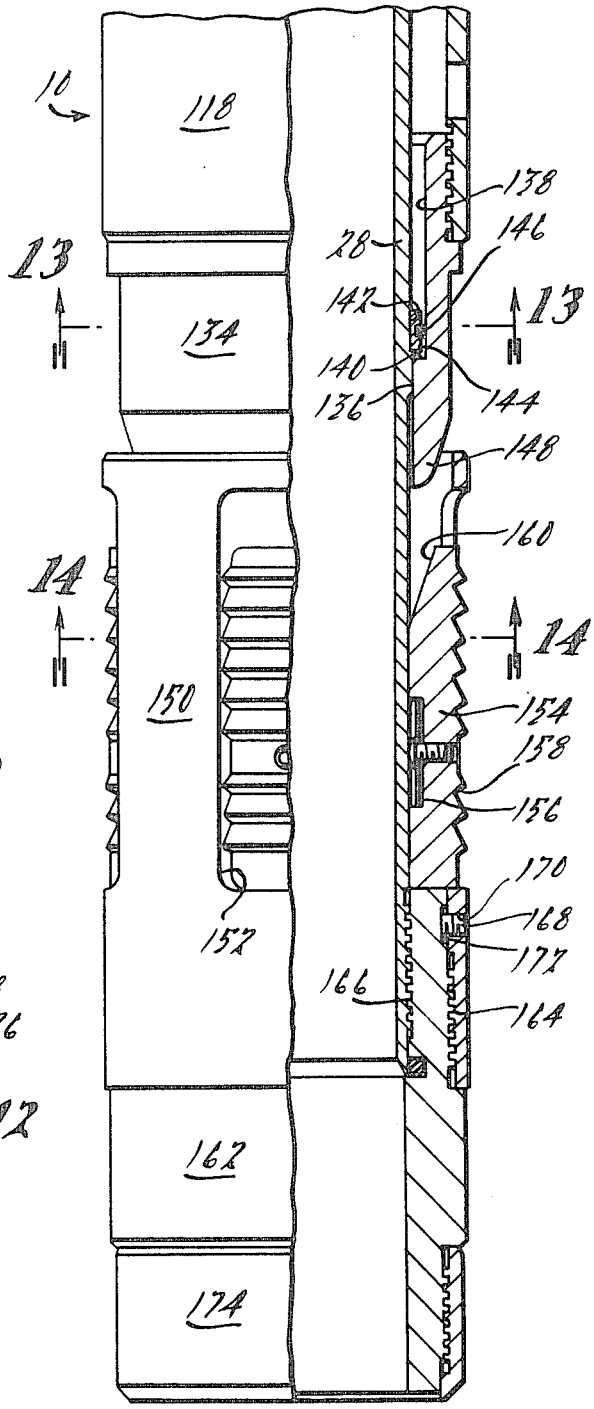
Figure 13:
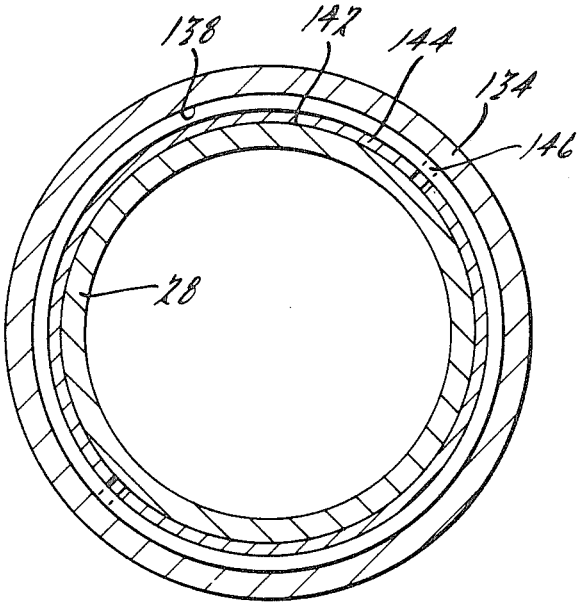

Referring now to FIG. 2*e*, a lower cone 134 is threaded into the lower end of the rubber retainer 118. The lower cone 134 is provided wth a first bore 136 haaving an inner diameter only slightly larger than the outer diameter of the inner mandrel 28 and a counterbore 138 at its upper end defining therebetween an internal upwardly oriented shoulder 140. A channel 142 (FIGS. 2*e* and 13) is provided in the outer surface of the inner mandrel 28 in the vicinity of the counterbore 138. A split ring 144 is inserted partly into the channel 142 and extends outwardly therefrom into the annular region between the upper mandrel 28 and the upper portions of the lower cone 134. An O-ring 146 is inserted into a channel in the split ring 144 to secure the segments of the split ring to each other and to the inner mandrel 28. The split ring 144 prevents the upward movement of the lower cone 134 beyond a position slightly above that illustrated in FIG. 2*e*.

The lower cone 134 is also provided with a conical portion 148 at its lowermost end similar to the conical portion 106 of the upper cone 104 described earlier.

Figure 14:
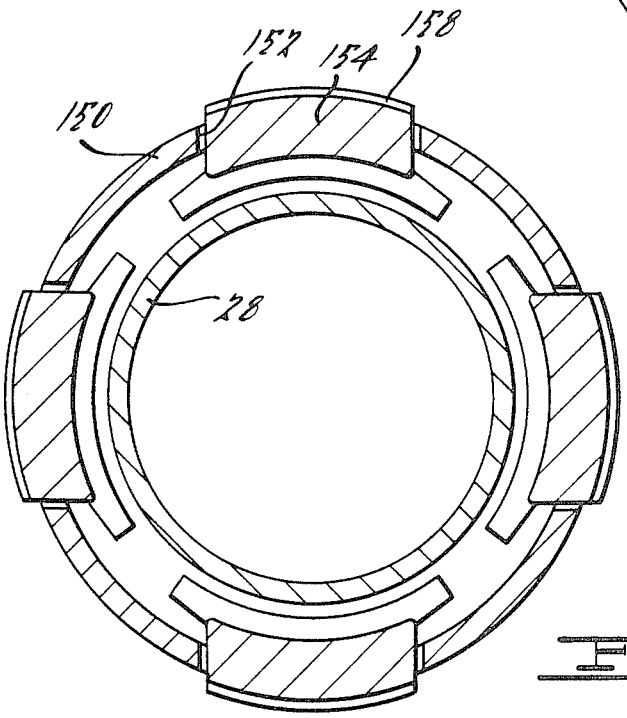

A lower slip body 150, similar to the upper slip body 76 described earlier, is loosely fitted onto the inner mandrel 28. The lower slip body 150 illustrated has four windows 152 for four slips 154 each having a spring 156 (not illustrated in FIG. 14), a casing gripping surface 158, and a outwardly and upwardly sloping inner surface 160 each designed similarly to the corresponding upper slip assembly components.

A bottom connection 162 is illustrated having an external thread 164 and an internal thread 166 whereby the upper end of the bottom connection is threaded into the lower end of the lower slip body 150 and onto the lower end of the lower slip body 150 and onto the lower end of the inner mandrel 28. A shear pin 168 is inserted into an aperture 170 in the lower slip body 150 and into a channel 172 in the bottom connection 162.

Figure 15A:
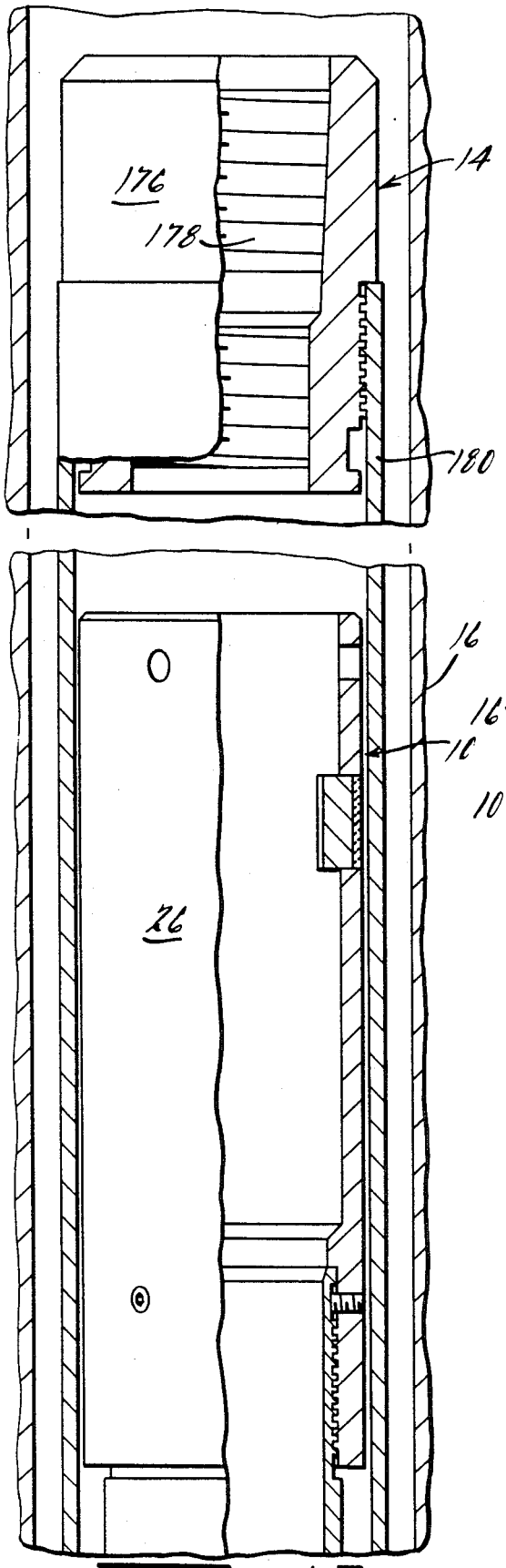
FIGS. 15*a* through 15*d* together form a partly cutaway view of the packer of FIGS. 1*a* and 1*b* set in a well bore and interconnected with a retrieving tool, FIGS. 15*b* through 15*d* generally forming a lower continuation of FIGS. 15*a* through 15*c*, respectively.
Figure 15B:
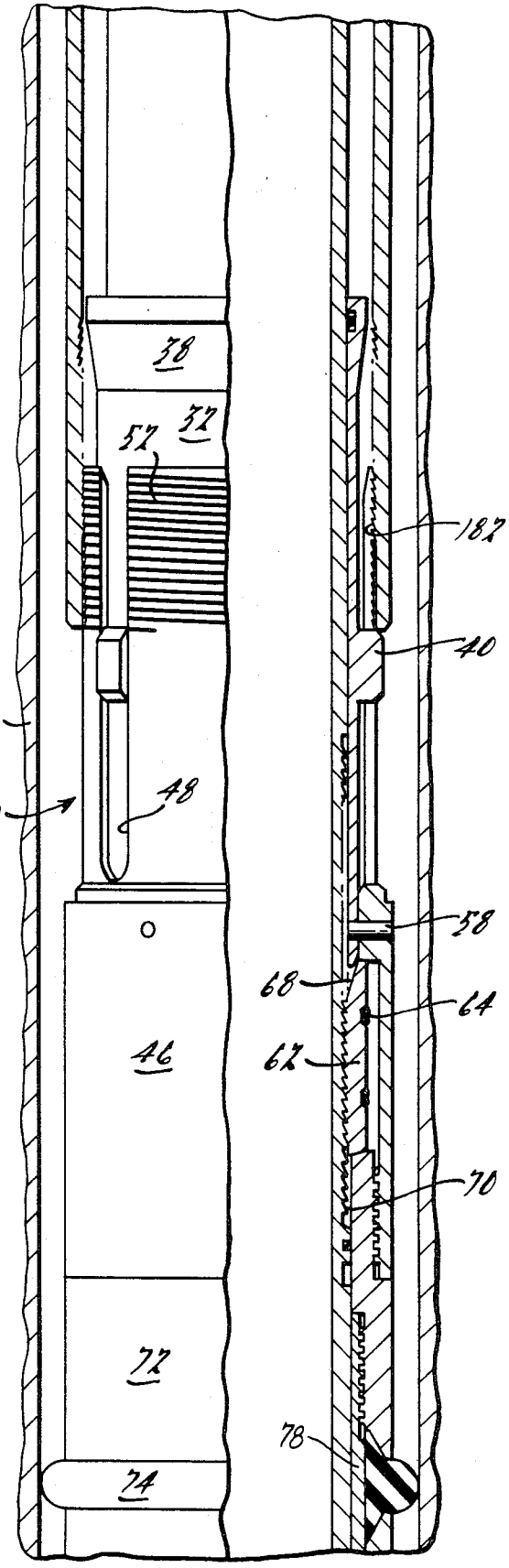
Figure 15C:
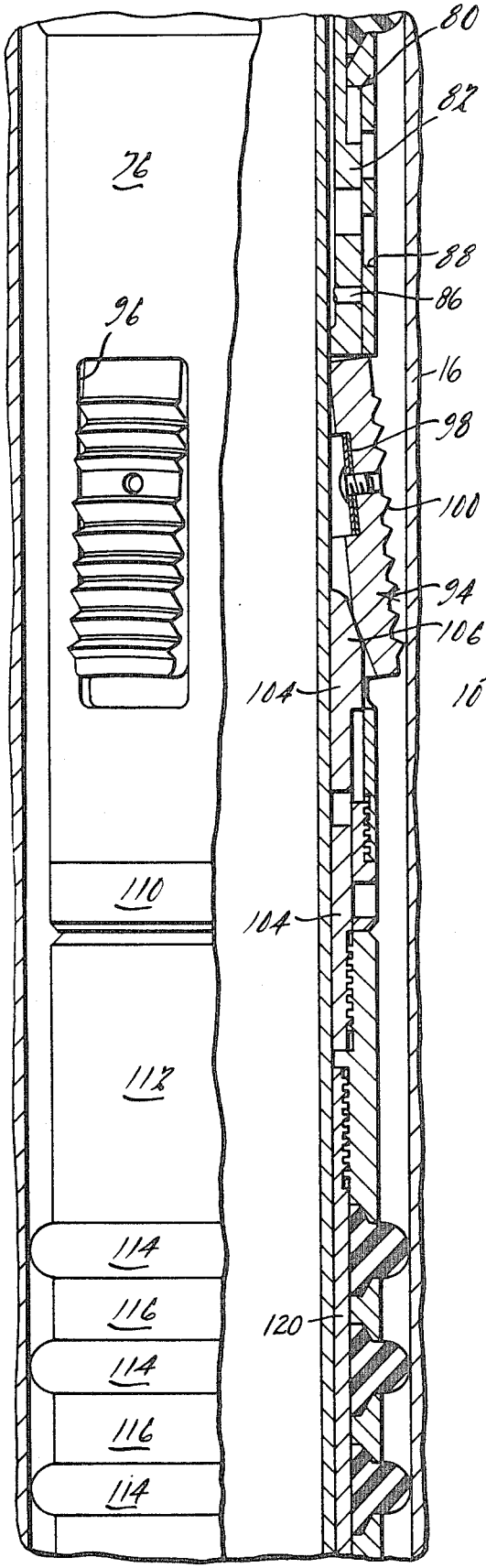
Figure 15D:
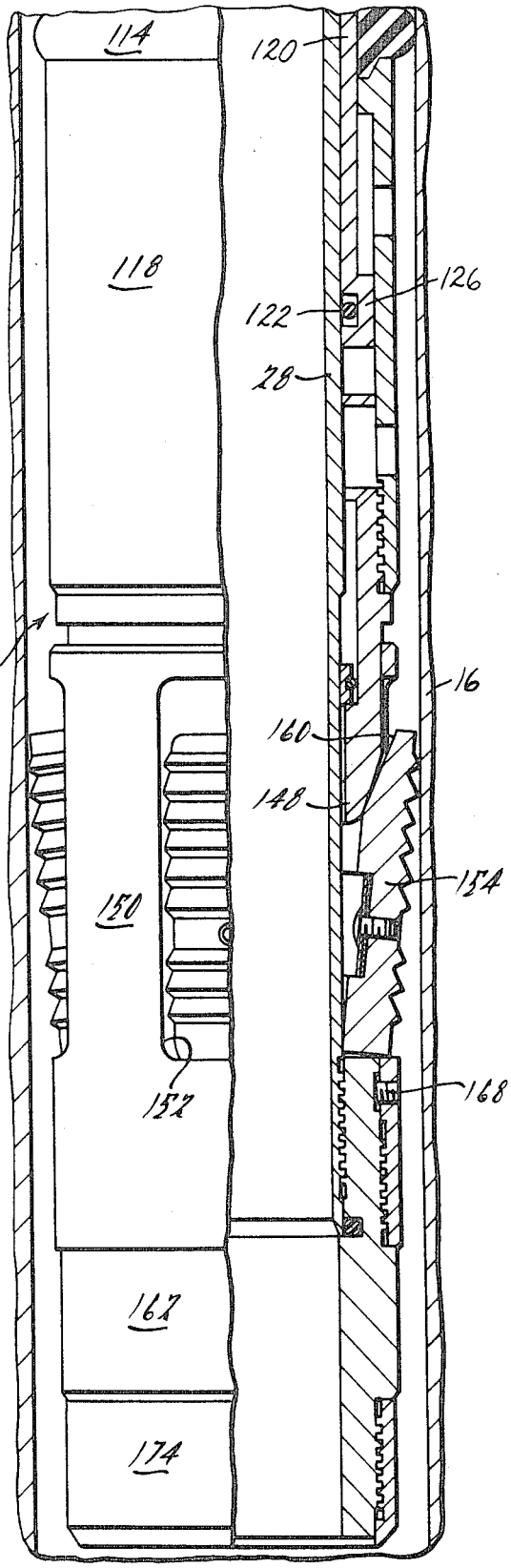

A cap or other element 174 may be threaded onto the lower end of the bottom connection 162. The elements of the retrieval tool 14 are illustrated in FIGS. 15*a* and 15*b*. Referring first to FIG. 15*a*, the retrieval tool 14 has a top connection sub 176 having an internal thread 178 for interconnection of the top connection sub 176 with a wireline. A retrieving sleeve 180 is threaded onto the lower end of the top connection sub 176 and extends downwardly over the packer 10. The lower end of the retrieving sleeve 180 is provided with an internal thread 182 capable of engaging the thread 52 on the release collet 46.

In operation, the packer 10 is interconnected with the setting tool 12 which, in turn, is interconnected with a wireline gun in the manner described above relative to FIGS. 1*a* and 1*b* and FIGS. 2*a* through 2*e*. The entire assembly is lowered into a casing 16 until it is at the desired location within the casing.

To set the packer in the casing 16, the wireline gun is actuated. As is well known in the art, upon actuation, the wireline gun will cause a relative motion between an inner connection and an outer connection. In the case of the present invention, the wireline gun will cause a relative motion between the setting sleeve 20 and the inner adapter 22. The setting sleeve 20 will be forced downwardly while the inner adapter 22 is simultaneously pulled upwardly.

The upward motion of the inner adapter 22 is transmited to the inner mandrel 28. The downward motion of the setting sleeve 20 is transmitted through the lugs 40 to the release sleeve 32. The downward motion of the release sleeve 32 is transmitted through the pin 54 to the release collet 46 and to the wireline body 72 and the upper rubber mandrel 78 which are directly interconnected with the release collet 46. The relative motion between the upper rubber mandrel 78 and the inner mandrel 28 shears the pin 86 (FIG. 2*c*).

As the outer elements are forced downwardly, the upper rubber 74 and the lower rubber 114 are compressed. Furthermore, the upper cone 106 slides under the upper slips 94 and the lower cone 134 slides under the lower slips 154 to force them into engagement with the casing 16. Additionally, the segmented nut 62 will be forced downwardly until it engages the locking teeth 70. Once the outer elements of the packer have been compressed to their limit, the force of the wireline gun will shear the pins 26 and thereby sever the setting tool from the packer. The locking nut 62 secures the packer in its locked condition.

After the packer 10 is set in the casing, the well pressure forces are transmitted through the lower rubbers 114 to the lower slip 154 on the diametrically opposite side of the mandrel from where the pressure is originating. Well pressure forces on the inner mandrel 28 are transmitted through the segmented nut 62 and the lower rubbers 114 to the lower slip 154. The upper rubber 74 protects the upper slips 94 from sand and settings.

The set condition of the packer is illustrated in FIGS. 15*a* through 15*d* which further illustrates a retrieving tool 14 being lowered into the casing to retrieve the packer 10. The retrieving sleeve 180 slides over the top connection and contacts the lugs 40 of the release sleeve 32. A continuing downward force is applied to the retrieving sleeve 180 will shear the shear pin 58 and cause the release sleeve 32 to slide relative to the release collet 46. The release sleeve 32 slides under the segmented nut 62 and releases it from the locking teeth 70 on the inner mandrel 28. As the release sleeve 32 continues to move relative to the release collet 46, the conical portion 38 of the release sleeve 32 will cause the segmented threaded portion of release collet 46 to flex and to latch into the threads 182 of the retrieving sleeve 180.

Once the retrieving sleeve 180 is interconnected with the release collet 46, an upward force on the retrieving tool 14 will pull the release collet 46 upwardly. This raises the wireline body 72, the upper rubber mandrel 78 and the upper slip body 76. This disengages the upper slips 94 from the casing 16.

A continued upward force on the retrieving tool 14 raises the upper cone 104, the center coupling 112, the lower rubber mandrel 120, the rubber retainer 118, and the lower cone 134. This disengages the lower slips 154 and the entire assembly may now be removed from the casing 16.

The retrievable packer 10 of the present invention is a highly flexible tool that offers the economy of a retrievable packer and the performance of a permanent packer. The packer 10 is run in and set on wireline, using a conventional wireline setting tool. It can be retrieved with tubing or wireline. A large, straight-through seal bore permits a number of accessories to be used with the packer to perform a variety of tasks in pumping, disposal or injection wells. These include testing, stimulation and other workovers, as well as producing oil or gas.

In setting the packer 10, the force of the wireline gun is applied directly to the packing elements, forming a solid pack-off, and is efficiently trapped in the elements between the releasable lock ring and the upper and lower slips. The slips and internal mechanisms are protected from settlings by an element located in the upper part of the tool, and protected from corrosive treating fluids and other contaminants by the main packing elements below.

Once set, the packer 10 solidly resists forces from either direction, whether generated by well and treating pressures or by set-down weight and tension from tubing. When a screw-out plug has been installed, packer can be used as a temporary bridge plug, and used later as a production packer without unsetting the packer.

Since the large bore through the center of the inner mandrel 28 is continuous throughout its length, the production string need not be latched onto the packer. When using several seal assemblies, tubing movement will not affect the seal. When desired, a latching sub may be run on the production string to lock onto the packer. This is released with only a half turn to the right. Because the releasing mechanism is remote from the packer bore, there is never a danger of releasing the tool accidentally.

It is sometimes desirable to produce a packer according to the present invention which will have a sequential release of the upper slips 94 rather than a simultaneous release of all the slips. This result can be obtained by varying the sizes of the slips 74 or of the windows 96 or both. Another variation of the slips 94 which would make one slip release more rapidly than another is to vary the angle of the teeth on one of the casing grabbing surfaces 100 of one of the slips 94.

An example of a sequentially releasing upper slip assembly which works well for a packer for insertion in a four and one half inch (4.5″) diameter casing is one in which only one of the slips 94 and one of the windows 96 have been attached. The similar windows in this example are one inch and seven-sixteenths of an inch (1.4375″) by three inches and five eights of an inch (3.625″) and the similar slips have a surface 100 of one inch and three-eights of an inch (1.375″) by three inches and one quarter of an inch (3.25″) with an angle of 60°. The different window in this example is one inch and one quarter of an inch (1.25″) by three inches and three-eights of an inch (3.375″) and is provided with an earlier releasing slip of one inch and three-sixteenths of an inch (1.1875″) by three inches and one quarter of an inch (3.25″) with an angle of 45°.

The foregoing is a detailed description of the best mode contemplated by the inventors at the time of filing the application for carrying out the invention. Variations and modifications from the above will be apparent to those skilled in the art. Such variations and modifications are within the scope of the present invention which is intended to be limited only by the scope of the claims appended hereto.

What is claimed as novel is as follows:

1. A well packer for setting in a casing, said well packer comprising:

mandrel adapted to be interconnected to a setting tool;

a plurality of slips circumferentially spaced about a particular point of an axis of said mandrel for selective engagement with said casing;

drive means adapted to be axially moveable upon actuation of said setting tool to bear against the top of said slips;

lower inclined surfaces about said mandrel to bear against the bottom of said slips to slide between said slip and said mandrel when said drive means is moved relative to said mandrel by actuation of said setting tool;

a sleeve coaxially mounted with said mandrel with circumferentially spaced apertures in said sleeve sized to receive a respective one of said slips, said slips having case engaging means extending through said aperture; and said apertures and said respective slips having differing relative dimensions to form varying clearances such that as when said sleeve is lifted relative to said mandrel, said sleeve sequentially releases one slip before the remaining slips.

2. A well packer as defined in claim 1 further comprising:

said inclined surfaces being provided by a conical portion on a lower member;

said slips being adapted to slide against said conical portion when said drive means moves relative to said mandrel such that said slips extend through said apertures in said sleeve member and engage said casing; a release means for raising said sleeve such that a lower edge of one aperture engages its respective slip and lifts it off of said conical surface before the lower edges of the other of said apertures engages their respective slip.

3. A well packer as defined in claim 2 further comprising:

said apertures having the same axial length;

said slips having an axial length sized to be received within said apertures and to provide for an axial clearance; and one of said slips having a longer axial length to provide for a smaller gap thereby allowing said one slip member to be released sequentially before the remaining slips.

4. A well packer as defined in claim 2 further comprising:

said slips having the same axial length;

said apertures in said sleeve having an axial length sized to receive said slips and to provide an axial clearance between said slips and said apertures; and one of said apertures having a shorter axial length than the remaining apertures to provide a smaller clearance between the said aperture and its respective slip thereby allowing said respective slip to be released sequentially before the remaining slips.

5. A well packer as defined in claim 1 further comprising:

a lower slip means engageable with said casing upon actuation of said setting tool;

a plurality of well packer seals interposed between said lower slip means and said plurality of upper circumferentially spaced slips to be sealably engaged against said casing upon actuation of said setting tool; and and upper seal member positioned above said upper slips and to be sealably engaged with said casing upon actuation of said setting tool.

6. A well packer for setting in a casing by use of a setting tool for producing relative movement between an inner connection element and outer connection elements, said well packer comprising:

a cylindrical mandrel adapted to be interconnected with one of said connection elements;

selectively engagable upper slip means on said mandrel for engagement with said casing;

lower engaging means mounted to bear against the bottom of said upper slip means;

an upper member slidably mounted to said mandrel and adapted to be interconnected with said other of said connection elements of said setting tool and moveable to a position to bear against the top of said upper slip means;

lower slip means operably mounted adjacent said mandrel;

a drive means for engagement with an upper section of said lower slip means;

resilient seal means encircling said mandrel and interposed between said upper and lower slip means and adapted to be compressed by said relative movement of said upper member and said mandrel whereby said seal means engages said casing and thereby forms a seal between said casing and said mandrel; and a second resilient seal means encircling said mandrel positioned above said upper slip means and adapted to be compressed by said relative movement of upper member and mandrel whereby said seal second seal means engages said casing and thereby forms a seal between said casing and said mandrel.

7. A well packer for setting in a casing by use of a wireline gun capable of producing relative movement between an inner connection element and an outer connection element, said well packer comprising:

a mandrel adapted to be interconnected with one of said connection elements of said wireline gun;

a plurality of selectively engageable slips circumferentially spaced about a particular point of an axis of said mandrel for engagement with said casing;

an upper member slideably mounted to said mandrel and adapted to be interconnected with the other of said connection elements of said wireline gun and moveable to a position to bear against the top of said slip means, and a lower abuttment member positioned below said slips and engageable to bear against the bottom of said slip means;

automatically engageable locking means for locking said upper member in said position wherein said upper member bears against said slip means whereby acutation of said wireline gun to cause relative movement between said mandrel and said upper member engages said slip means;

means selectively operable to disengage said locking means by a downward pressure on said upper member;

a sleeve coaxially mounted with said mandrel with circumferentially spaced apertures in said sleeve sized to receive a respective one of said slips, said slips having case engaging means extending through said aperture;

said apertures and said respective slips having differing relative dimensions to form varying clearances such that as when said sleeve is lifted relative to said mandrel, said sleeve sequentially releases one slip before the remaining slips.

* * * * *